US008974190B2

(12) United States Patent
Bonnefoi et al.

(10) Patent No.: US 8,974,190 B2
(45) Date of Patent: Mar. 10, 2015

(54) VARIABLE-SPEED SCROLL REFRIGERATION COMPRESSOR

(71) Applicant: Danfoss Commercial Compressors, Trevoux (FR)

(72) Inventors: Patrice Bonnefoi, Saint Didier Au Mont d'Or (FR); Feifei Wang, Tianjin (CN)

(73) Assignee: Danfoss Commercial Compressors, Reyrieux (FR)

( * ) Notice: Subject to any disclaimer, the term of this patent is extended or adjusted under 35 U.S.C. 154(b) by 257 days.

(21) Appl. No.: 13/715,214

(22) Filed: Dec. 14, 2012

(65) Prior Publication Data

US 2013/0156623 A1 Jun. 20, 2013

(30) Foreign Application Priority Data

Dec. 14, 2011 (FR) ..... 11 61592

(51) Int. Cl.

| | |
|---|---|
| ***F04C 18/00*** | (2006.01) |
| ***F04B 49/06*** | (2006.01) |
| ***F04C 28/06*** | (2006.01) |
| ***F04C 28/08*** | (2006.01) |
| ***F04C 29/02*** | (2006.01) |
| ***F04C 18/02*** | (2006.01) |
| ***F04C 23/00*** | (2006.01) |

(52) U.S. Cl.

CPC ..... *F04C 18/00* (2013.01); *F04C 28/06* (2013.01); *F04C 28/08* (2013.01); *F04C 29/025* (2013.01); *F04C 18/0215* (2013.01); *F04C 23/008* (2013.01)

USPC ..... 417/45

(58) Field of Classification Search

USPC ..... 417/12, 44.1, 45, 44.11

See application file for complete search history.

(56) References Cited

U.S. PATENT DOCUMENTS

| | | | | |
|---|---|---|---|---|
| 5,253,481 | A | 10/1993 | Takagi et al. | |
| 5,395,214 | A * | 3/1995 | Kawahara et al. | 417/53 |
| 5,846,062 | A * | 12/1998 | Yanagisawa et al. | 417/410.4 |
| 2007/0183916 | A1 | 8/2007 | Kim et al. | |
| 2010/0119378 | A1 * | 5/2010 | Shibamoto et al. | 417/44.1 |

FOREIGN PATENT DOCUMENTS

| | | | |
|---|---|---|---|
| DE | 10 2006 058 229 | A1 | 7/2007 |
| FR | 2 885 966 | A1 | 11/2006 |
| FR | 2 916 813 | A1 | 12/2008 |
| JP | A-06-185479 | | 7/1994 |
| WO | WO 2008/041996 | A1 | 4/2008 |

OTHER PUBLICATIONS

French Search Report issued in Application No. 1161592; Dated Oct. 11, 2012 (Translation Only).

* cited by examiner

*Primary Examiner* — Bryan Lettman
(74) *Attorney, Agent, or Firm* — Oliff PLC

(57) ABSTRACT

The compressor includes a sealed enclosure containing a compression stage, an electric motor having a stator and a rotor, an oil pump rotationally coupled to the rotor, including an oil inlet port connected to an oil sump, and control means arranged to command the operation of the motor in a start-up mode in which the rotor is rotated at a first speed of rotation included in a first speed range, and a normal operating mode in which the rotor is rotated at a second speed of rotation included in a second speed range higher than the first speed range. The compressor includes an oil injection device having an oil injection duct connected to a first oil outlet port of the oil pump and arranged to supply the compression stage with oil.

9 Claims, 4 Drawing Sheets

VARIABLE-SPEED SCROLL REFRIGERATION COMPRESSOR

The present invention relates to a variable-speed scroll refrigeration compressor.

Document FR 2 885 966 describes a variable-speed scroll refrigeration compressor, comprising a sealed enclosure containing a compression stage, an electric motor equipped with a stator and rotor, a drive shaft rotationally coupled to the rotor of the electric motor, the drive shaft comprising a first end arranged to drive the motion of a moving part of the compression stage, and a second end rotationally coupled to an oil pump arranged to supply, from oil contained in the sump situated in the lower portion of the enclosure, a lubrication duct formed in the central portion of the drive shaft. The lubrication duct includes lubrication ports at the various guide bearings of the drive shaft.

When such a compressor is stopped for a prolonged period of time, the refrigerant present inside the compressor may condense, in particular on the parts making up the compression stage of the guide bearings of the drive shaft, and thereby cause degreasing of those various parts. Such degreasing involves significant forces when the compressor is restarted, in particular between the parts making up the compression stage, and between the drive shaft and the guide bearings of the latter part, which causes significant and premature wear of those various parts, as well as vibration phenomena. Furthermore, a so-called "dry" start-up, which is very harmful for the compressor, cannot be avoided in the case of complete or nearly complete degreasing.

This wear is even more significant inasmuch as, during the start-up of such compressor, the rotor is rotated at a high speed, which creates significant forces at the previously mentioned parts.

Document U.S. Pat. No. 5,253,481 describes a solution to limit the wear of these various parts during restarting of the compressor after a prolonged stop thereof. The solution consists of providing a start-up phase of the compressor at a very low speed, before a normal operation phase of the compressor.

Thus, document U.S. Pat. No. 5,253,481 describes a variable-speed scroll refrigeration compressor in particular comprising control means arranged to control the operation of the electric motor according to at least one start-up mode in which the rotor of the electric motor is rotated at a first speed of rotation comprised in a first speed range, and a normal operating mode in which the rotor is rotated at a second speed of rotation comprised in a second speed range greater than the first speed range.

The first speed of rotation is approximately one revolution per second so as to ensure circulation of the refrigerant inside the compressor and discharge of the excess refrigerant outside the compressor on the one hand, and a supply of oil for the lubrication duct of the drive shaft on the other hand, without creating significant forces on the parts making up the compression stage and on the guide bearings. During the circulation of the refrigerant in the compressor, said refrigerant, which is slightly charged with oil, participates in a slight lubrication of the parts of the compressor with which it comes into contact. Furthermore, the lubrication duct of the drive shaft participates in particular in lubricating the guide bearings.

The compressor described in document U.S. Pat. No. 5,253,481 thereby makes it possible to avoid any risk of a so-called "dry" start-up of the compressor, and to limit vibration phenomena.

However, due to the low-speed driving of the rotor, the oil pump does not allow a significant injection of oil into the lubrication duct formed inside the drive shaft.

As a result, during the start-up mode, the component pieces of the compression stage are not lubricated or are only very slightly lubricated, which necessarily leads to the creation of significant forces on those parts in the first phase of the normal operating mode. This results in premature wear of the parts making up the compression stage.

The present invention aims to resolve this drawback.

The technical problem at the base of the invention therefore consists of providing a variable-speed scroll refrigeration compressor that has a simple and cost-effective structure, while limiting the risks of premature wear of the compressor.

To that end, the present invention relates to a variable-speed scroll refrigeration compressor, comprising:

- a sealed enclosure containing a compression stage,
- an oil sump housed in the lower portion of the sealed enclosure,
- an electric motor having a stator and a rotor,
- an oil pump rotationally coupled to the electric motor, the oil pump comprising an oil inlet port connected to the oil sump of the compressor and at least one first oil output port, and
- control means arranged to control the operation of the electric motor according to at least one start-up mode in which the rotor of the electric motor is rotated at a first speed of rotation comprised in a first speed range, and a normal operating mode in which the rotor is rotated a second speed of rotation comprised in a second speed range, the second speed range being higher than the first speed range, wherein the compressor comprises an oil injection device including at least one oil injection duct connected to the first oil outlet port of the oil pump and arranged to supply the compression stage of the compressor with oil, and the control means include monitoring means arranged to vary a value that is representative of the output torque of the electric motor so as to keep the first speed of rotation substantially constant during the start-up mode, the control means being arranged to control the operation of the electric motor in the start-up mode until the value representative of the output torque becomes lower than a predetermined value.

The presence of such an oil injection device ensures, during the start-up phase of the compressor, satisfactory lubrication of the parts of the compression stage, despite a low speed of rotation of the rotor, and therefore the oil pump. As a result, the injection device makes it possible to limit the forces applied on the parts making up the compression stage during the first phase of the normal operating mode of the compressor.

Furthermore, such a configuration of the control means makes it possible to ensure maintenance of the start-up mode until the component parts of the compression stage are sufficiently lubricated.

The control and monitoring means may for example be made up of program elements or software elements run by one or more processors, or for example by a dedicated electronic circuit designed to implement the desired control logic.

The monitoring and control means may in particular be made up of elements of the same computer program run by one or more processors, in particular by the same processor.

The control means may also be formed by an electronic control unit.

It should be noted that the start-up mode is used irrespective of the surrounding conditions of the compressor, and is not limited to low temperature conditions, for example.

The injection device thus greatly limits the risks of premature wear of the compressor.

According to one embodiment of the invention, the first speed of rotation is comprised between 2 and 10% of the maximum continuous speed of rotation of the electric motor.

The bearings and the body supporting the compression stage have a certain capacity to operate without oil. That capacity depends on their size, their material, and the forces they must bear. Knowing the maximum forces, it is therefore easy to deduce the speed after which oil must be provided. This intrinsic capacity of the bearings and the body makes it possible to set the lower value of the first speed range (2%).

According to one embodiment of the invention, the second speed of rotation is comprised between 12.5 and 100% of the maximum continuous speed of rotation of the electric motor, and advantageously between 15 and 100% of the maximum continuous speed of rotation of the electric motor.

Preferably, the second speed of rotation varies in the second speed range. According to one embodiment, the second speed of rotation varies from a minimum value to a maximum value. The second speed of rotation can vary from the minimum value to the maximum value, for example, continuously or by level.

Advantageously, the monitoring means are arranged to vary the feed current of the electric motor so as to keep the first speed of rotation substantially constant during the start-up mode, the control means being arranged to command operation of the electric motor in the start-up mode until the value of the feed current of the electric motor becomes lower than a predetermined current value.

Advantageously, the compressor comprises a drive shaft rotationally coupled to the rotor of the electric motor and arranged to rotate the oil pump, the oil pump comprising a second oil outlet port connected to a lubrication duct formed in the central portion of the drive shaft.

According to one embodiment of the invention, the drive shaft comprises a first end arranged to drive a moving part of the compression stage, and a second end rotationally coupled to the oil pump. The drive shaft preferably comprises lubrication ports respectively emerging on the one hand in the lubrication duct and on the other hand in the outer surface of the drive shaft. Each lubrication port advantageously emerges at a guide bearing of the drive shaft.

According to one embodiment of the invention, the sealed enclosure has a suction volume and a compression volume respectively arranged on either side of the body contained in the sealed enclosure, the suction volume including the oil sump and the compression volume including the compression stage, an end of each oil injection duct opposite the oil pump emerging in the compression volume. Advantageously, the compression stage comprises a stationary volute and a moving volute driven in an orbital movement, the stationary volute being equipped with a scroll engaged in a scroll of the moving volute, the moving volute bearing against the body separating the compression and suction volumes.

Preferably, the end portion of each oil injection duct opposite the oil pump is inserted into a through bore formed in the body separating the compression and suction volumes.

Advantageously, each oil injection duct comprises a choke member, such as an injection nozzle, mounted at the end of the oil injection duct opposite the oil pump.

Preferably, the oil injection device includes a plurality of oil injection ducts.

Advantageously, each oil injection duct has a substantially constant transverse section. Preferably, each oil injection duct is a flexible or rigid tubing. Each injection duct advantageously extends inside the enclosure of the compressor.

Preferably, the oil pump is a displacement pump, for example with gears.

According to a first alternative embodiment of the invention, the oil injection device also comprises an oil return duct connected to the first oil output port of the oil pump and designed to return the oil into the oil sump of the compressor, and each oil injection duct in the oil return duct is configured such that the pressure losses in each oil, injection duct are primarily singular pressure losses proportional to the square of the oil flow rate passing through said oil injection duct, and the pressure losses in the oil return duct are primarily pressure losses due to friction proportional to the oil flow rate passing through the oil return duct.

According to one embodiment, each oil injection duct in the oil return duct is configured such that the pressure losses in each oil injection duct may for example be lower than the pressure losses in the oil return duct when the speed of rotation of the rotor is below a first predetermined value belonging to the second speed range, and such that the pressure losses in each oil injection duct are greater than the pressure losses in the oil return duct when the speed of rotation of the rotor is above a second predetermined value belonging to the second speed range, the second predetermined value being greater than or identical to the first predetermined value.

The oil injection device preferably comprises a connector including at least one oil inlet port supplied with oil by a supply duct connected to the first output port of the oil pump, a first oil outlet port connected to the at least one oil injection duct, and a second oil outlet port connected to the oil return duct. The connector may for example be housed in the sealed enclosure of the compressor.

According to a second alternative embodiment of the invention, the oil injection device comprises a solenoid valve having a body mounted on the sealed enclosure and a core housed in the body of the solenoid valve, the body of the solenoid valve having at least one oil inlet port supplied with oil by a supply duct connected to the first outlet port of the oil pump, a first oil outlet port connected to the at least one oil injection duct emerging in the compression stage, and a second oil outlet port emerging in the sealed enclosure, the core being able to move, under the effect of a magnetic field, between the closing position of the second oil outlet port, in which all of the oil entering the solenoid valve through the oil inlet port is oriented toward the first oil outlet port, and an open position of the second oil outlet port, in which all or nearly all of the oil entering the solenoid valve through the oil inlet port is oriented toward the second oil outlet port.

The compressor advantageously comprises monitoring means arranged to move the core of the solenoid valve between its open and closed positions as a function of the speed of rotation of the rotor of the electric motor. The monitoring means are preferably arranged to move the core of the solenoid valve into its open position when the speed of the rotor is above a predetermined value belonging to the second speed range.

In any event, the invention will be well understood using the following description in reference to the appended diagrammatic drawing showing, as non-limiting examples, two embodiments of the compressor.

Figure 1:
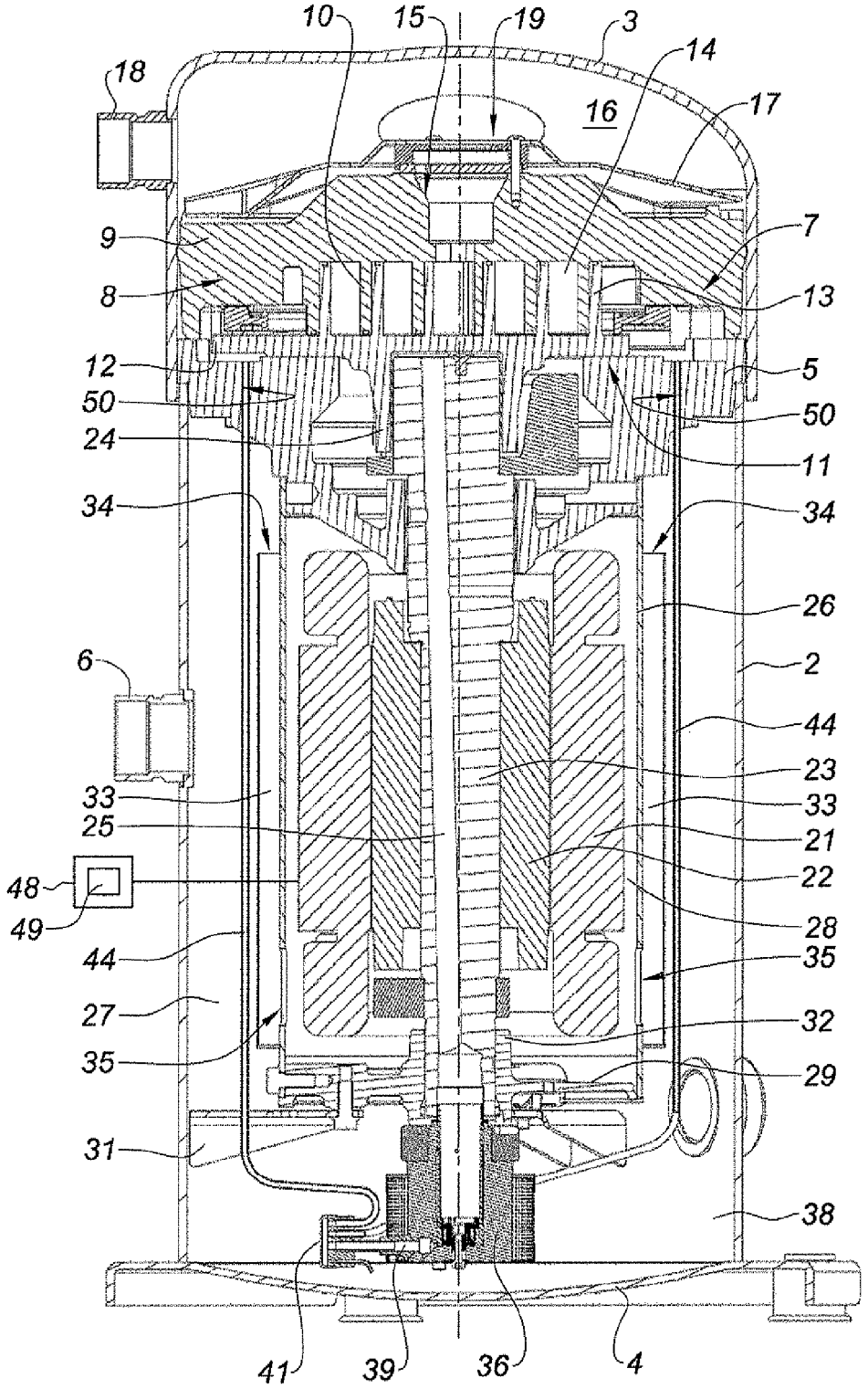
FIG. 1 is a longitudinal cross-sectional view of a compressor according to a first embodiment of the invention.

FIG. 1 describes a scroll refrigeration compressor in a vertical position. However, the compressor according to the invention may be in a tilted position or a horizontal position, without its structure being significantly altered.

The compressor shown in FIG. 1 comprises a sealed enclosure delimited by a shroud 2, the upper and lower ends of which are respectively closed by a cover 3 and the base 4. The assembly of this enclosure may in particular be done using weld seams.

The intermediate part of the compressor is occupied by a body 5 that delimits two volumes, i.e. a suction volume situated below the body 5 and a compression volume arranged above the body. The shroud 2 comprises a refrigerant inlet 6 emerging in the suction volume to bring refrigerant into the compressor.

The body 5 is used to mount a compression stage 7 for the refrigerant. Said compression stage 7 comprises a stationary volute 8 including a plate 9 from which a stationary scroll 10 extends turned downward, and moving volute 11 including a plate 12 bearing against the body 5 and from which a scroll 13 extends turned upward. The two scrolls 10 and 13 of the two volutes penetrate one another to form variable-volume compression chambers 14.

The compressor also comprises a discharge duct 15 formed in the central portion of the stationary volute 8. The discharge duct 15 comprises a first end emerging in the central compression chamber and a second end intended to be put in communication with a high-pressure discharge chamber 16 formed in the enclosure of the compressor. The discharge chamber 16 is delimited partially by a separating plate 17 mounted on the plate 9 of the stationary volute 8 so as to surround the discharge duct 15.

The compressor also comprises a refrigerant outlet 18 emerging in the discharge chamber 16.

The compressor also comprises a non-return device 19 mounted on the plate 9 of the stationary volute 8 at the second end of the discharge duct 15, and in particular having a discharge valve that can move between a closing position, preventing the discharge duct 15 and the discharge chamber 16 from being put in communication, and a released position, allowing the discharge duct 15 and the discharge chamber 16 to be put in communication. The discharge valve is designed to be moved into its released position when the pressure in the discharge duct 15 exceeds the pressure in the discharge chamber 16 by a first predetermined value substantially corresponding to the adjustment pressure of the discharge valve.

The compressor comprises a three-phase electric motor arranged in the suction volume. The electric motor comprises a stator 21, at the center of which a rotor 22 is arranged. The rotor 22 is secured with a drive shaft 23, the upper end of which is off-centered like a crankshaft. This upper portion is engaged in a sleeve or bush 24 of the moving volute 11. When it is rotated by the motor, the drive shaft 23 drives the moving volute 11 following an orbital movement. The drive shaft 23 comprises a lubrication duct 25 formed in the central portion thereof. The supply duct 25 is off-centered and preferably extends over the entire length of the drive shaft 23. The drive shaft 23 also comprises lubrication ports respectively emerging on the one hand in the lubrication duct 25 and on the other hand in the outer surface of the drive shaft. Preferably, the drive shaft 23 comprises a lubrication port at each guide bearing of the drive shaft.

The compressor also comprises an intermediate jacket 26 surrounding the stator 21. The upper end of the intermediate jacket 26 is secured on the body 5 separating the suction and compression volumes, such that the intermediate jacket 26 is used to fasten the electric motor. The intermediate jacket 26 on the one hand delimits an annular outer volume 27 with the sealed enclosure, and on the other hand an inner volume 28 containing the electric motor.

The compressor also comprises a centering piece 29, fastened on the sealed enclosure using a fastening piece 31, provided with a guide bearing 32 arranged to guide the lower end portion of the drive shaft 23. The lower end of the intermediate jacket 26 rests on the centering piece 29 such that the centering piece substantially closes all of the lower end of the intermediate jacket.

The compressor also includes an oil separator device mounted on the outer wall of the intermediate jacket 26. The oil separator device includes at least one refrigerant circulation channel 33, and for example two refrigerant circulation channels 33. Each refrigerant circulation channel 33 has a refrigerant inlet opening 34 emerging in the annular outer volume 27 and a refrigerant outlet opening emerging in the inner volume 28.

According to one embodiment of the invention, the refrigerant outlet opening emerges at a window 35 formed in the intermediate jacket 26 so as to put the refrigerant circulation channel 33 and the inner volume 28 delimited by the intermediate enclosure 26 in communication.

Advantageously, the refrigerant inlet opening 34 is axially offset relative to the refrigerant inlet 6, and is situated near the end of the electric motor turned toward the compression stage 7.

The compressor is configured such that under usage conditions, a flow of refrigerant circulates through the refrigerant inlet 6, the annular outer volume 27, the refrigerant circulation channel 33, the window 35, the inner volume 28, the compression stage 7, the discharge duct 15, the non-return device 19, the discharge chamber 16 and the refrigerant outlet 18.

The compressor also comprises an oil pump 36 housed in the lower portion of the sealed enclosure. The oil pump 36 is rotationally coupled to the lower end of the drive shaft 23. The oil pump 36 is advantageously a displacement pump, for example with gears.

The oil pump 36 comprises an oil inlet port 37 emerging in an oil sump 38 delimited partially by the base 4 and the shroud 2, a first oil outlet port 39 and a second oil outlet port 40.

The second oil outlet port 40 is connected to the lubrication duct 25 formed in the central portion of the drive shaft 23. The oil pump 36 is thus arranged to supply the lubrication duct 25 with oil from the oil contained in the oil sump 38.

Figure 2:
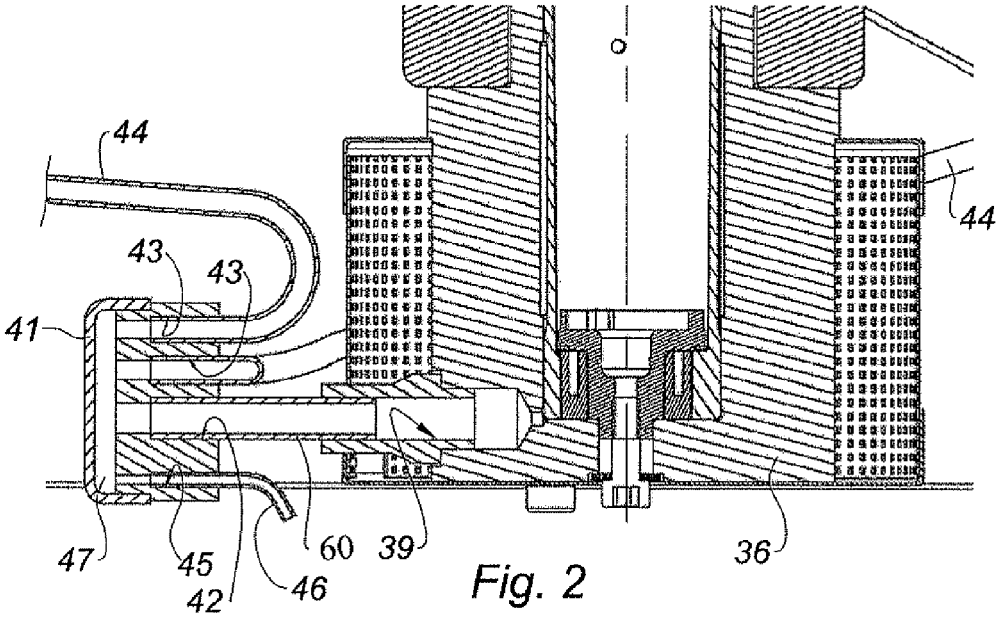
FIG. 2 is an enlarged view of a detail of FIG. 1.
Figure 3:
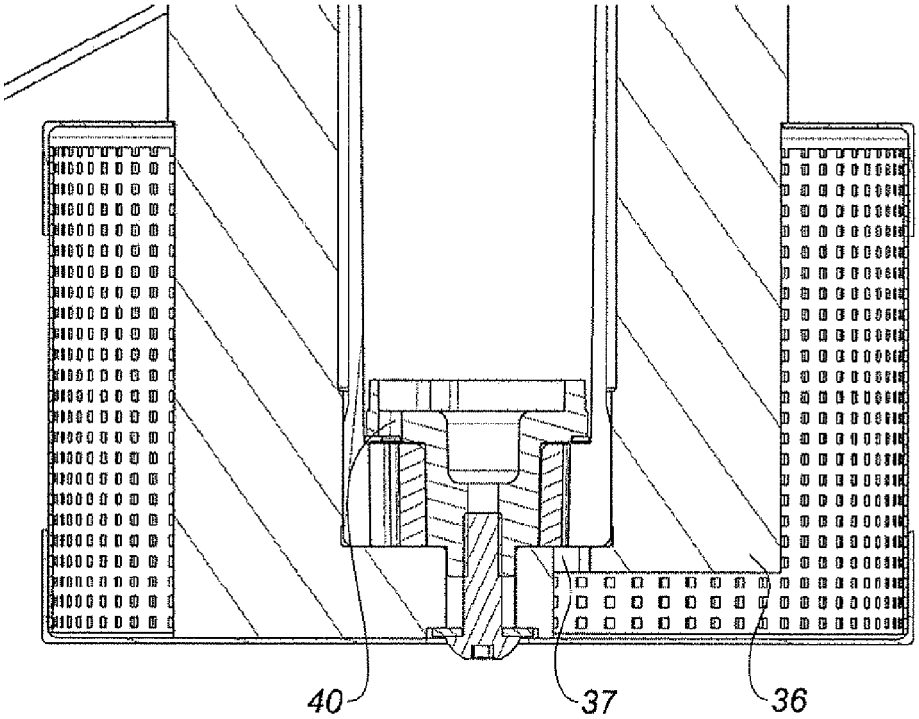
FIG. 3 is an enlarged cross-sectional view of the displacement pump of the injection device of FIG. 1.

The compressor comprises an oil injection device having a connector 41 housed in the sealed enclosure of the compressor. The connector 41 includes, as shown more particularly in FIG. 2, an oil inlet port 42 supplied with oil through a supply duct 43 connected to the first oil outlet port 39 of the oil pump 36, a first oil outlet port 43 connected to the oil injection duct 44 designed to supply the compression stage 7 with oil, and a second oil outlet port 45 connected to an oil return duct 46 designed to return oil into the oil sump 38. The oil pump 36 is thus also arranged to supply the compression stage 7 with oil via the supply duct 43 and the oil injection duct 44.

The oil inlet port 42 is connected to the oil outlet ports 43, 45 by a connecting chamber 47 formed in the connector 41.

Advantageously, the oil injection device includes a second oil injection duct 44. According to one embodiment of the invention, the connector 41 has a second oil outlet port 43 emerging in the connecting chamber 47 and connected to the second injection duct 44. According to another embodiment of the invention, the two oil injection ducts 44 are connected to the same outlet port 43 by means of a duct portion.

The end portion of each oil injection duct 44 opposite the oil pump 36 is inserted into a through bore 50 formed in the body 5 separating the compression and suction volumes.

Each oil injection duct 44 includes an injection tubing having a substantially constant transverse section.

The oil injection ducts 44 are configured such that the pressure losses in each oil injection duct 44 are primarily singular pressure losses proportional to the square of the oil flow rate in the oil injection duct 44. In this way, each oil injection duct 44 also comprises a choke member, such as an injection nozzle, mounted at the end of the respective injection tubing opposite the oil pump 36.

Advantageously, the oil return duct 46 is formed by a tubing having a substantially constant transverse section. The pressure losses in the oil return duct 46 are primarily pressure losses due to friction proportional to the oil flow rate in the oil return duct 46.

The compressor also has a control unit 48 arranged to control the operation of the electric motor according to at least one start-up mode in which the rotor of the electric motor is rotated at a first speed of rotation V1 comprised in a first speed range, and a normal operating mode in which the rotor is rotated at a second speed of rotation V2 comprised in a second speed range higher than the first speed range.

The first speed of rotation V1 is substantially constant, and advantageously comprised between 2 and 10% of the maximum continuous speed of rotation of the electric motor.

The second speed of rotation V2 is preferably variable, and advantageously varies in the second speed range. The second speed of rotation can vary between a minimum value and a maximum value, for example continuously or by level.

The control unit 48 includes monitoring means 49 arranged to vary a value representative of the output torque of the electric motor so as to keep the first speed of rotation V1 substantially constant during the start-up mode, and the control unit 48 is arranged to command the operation of the electric motor in the start-up mode until the value representative of the output torque from the electric motor becomes lower than a predetermined value. Advantageously, the monitoring means 49 are arranged to vary the value of the feed current of the electric motor so as to keep the first speed of rotation V1 substantially constant during the start-up mode, and the control unit 48 is arranged to command operation of the electric motor in the start-up mode until the value of the feed current of the electric motor becomes lower than a predetermined current value.

Figure 4:
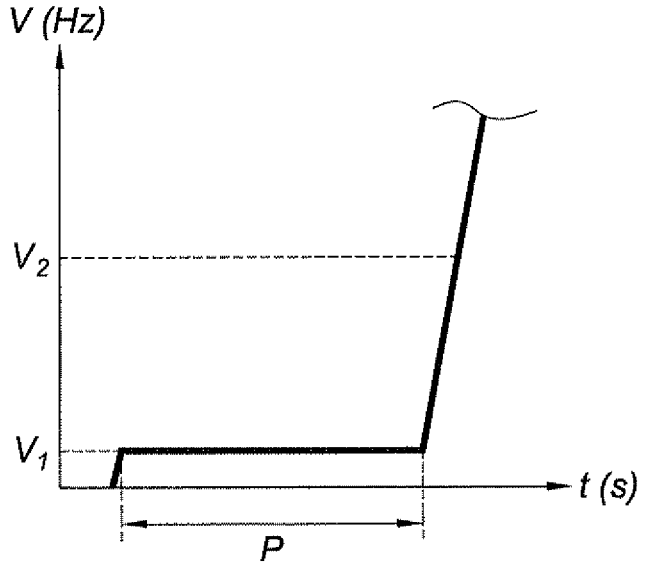
FIG. 4 is a diagram showing the speed of rotation of the motor of the compressor of FIG. 1 as a function of time.

As shown in FIG. 4, the control unit 48 is arranged to command the operation of the electric motor in the start-up mode for a variable period of time P corresponding to the necessary period of time, from the command of the start-up mode, for the value of the feed current of the electric motor to become lower than a predetermined current value. When the feed current value becomes lower than the predetermined current value, the control unit 48 is arranged to command the operation of the electric motor in the normal operating mode.

The operation of the scroll compressor will now be described.

When the scroll compressor according to the invention is started, the control unit 48 commands the electric motor in the start-up mode such that the rotor 22 is rotated at the first speed of rotation V1, i.e. at a low speed. The rotor 22 then rotates the drive shaft 23 such that the oil pump 36 supplies the supply duct 43 and the lubrication duct 25 from oil contained in the sump 38. The oil circulating in the lubrication duct 25 then penetrates the lubrication ports formed in the drive shaft 23 so as to lubricate the guide bearings of the drive shaft. The oil circulating in the supply duct 43 then penetrates the oil inlet port 42 of the connector 41. The rotor 22 being run in the start-up mode, the speed of rotation of the rotor, and therefore the oil pump 36, is low. Thus, the pressure losses in each oil injection duct 44 are relatively low. As a result, a significant proportion of the oil having penetrated the connector 41 is oriented toward the first and second injection ducts 44 via the connecting chamber 47 and the first output port 43. Lastly, the oil is injected into the compression stage 7 by means of the injection nozzles mounted at the ends of the injection ducts 44. It should be noted that the end of at least one of the oil injection ducts 44 opposite the oil pump 36 is covered by the moving the volute 11 during at least part of the orbital movement of the latter part. As a result, the oil injected into the compression stage 7 ensures lubrication of the interface between the body 5 and the moving volute 11.

In this way, when the electric motor is operating in the start-up mode, the oil injection device and the lubrication duct ensure complete lubrication of the parts of the compression stage and the guide bearings.

Furthermore, given that the first speed of rotation V1 is very low relative to a normal operating speed of the motor, the forces exerted in particular on the stationary and moving volutes of the compression stage are not very high during operation of the motor in the start-up mode.

As a result, the combination of the control unit and the injection device ensures, during start-up of the compressor, complete lubrication of the parts of the compression stage and guide bearings, while limiting the risks of wear of those parts.

When the compressor is started up, the parts making up the compression stage 7 and guide bearings of the drive shaft 23 are slightly lubricated, with the result that the forces applied on those parts, and therefore the resistant torque applied on the rotor 22, are not very high. The feed current of the electric motor must thus be relatively low such that the output torque from the motor can counter that resistant torque, and ensure that the first speed of rotation is kept at the desired value. As previously indicated, during the rotation of the rotor 22, the injection device supplies the compression stage with oil, which results in improving the lubrication of the parts making up the compression stage, and therefore reducing the forces applied on those parts on the one hand, and the resistant torque exerted on the rotor 22 on the other hand. As a result, the monitoring means 49 can decrease the value of the feed current of the electric motor so as to ensure that the first speed of rotation V1 is kept at the desired value.

Once the value of the feed current becomes lower than the predetermined value, which is predetermined to ensure sufficient lubrication of the parts making up the compression stage in the guide bearings, the control unit 48 commands the transition to the normal operating mode, such that the rotor 22 is rotated at the second speed of rotation V2, i.e. a high speed. At such a speed of rotation of the rotor, the forces exerted on the parts of the compression stage are significant. However, due to the proper lubrication of those parts during the start-up phase of the compressor, the wear of those parts is greatly limited.

As the speed of the compressor, and therefore of the oil pump, increases, the proportion of oil entering the connector 41 through the oil inlet port 42 and oriented toward the oil injection ducts 44 decreases, while the proportion of oil feeding the oil return duct 46 and returned into the oil sump 38 of the compressor increases, in light of the fact that the pressure losses in each injection duct 44 increase much more quickly with the flow rate passing through each injection duct 44 than the pressure losses in the oil return duct 46.

At a high speed of the rotor, and therefore the oil pump, the majority of the oil entering the connector 41 through the oil inlet port 42 is oriented toward the oil return duct 44 via the second oil outlet port 45, and falls by gravity into the oil sump 38.

Consequently, the injection device makes it possible to limit the quantity of oil injected into the compression stage during normal operation of the compressor, and therefore to limit the level of oil in the refrigerant at a high speed of the compressor. As a result, the performance of the compressor is improved at low speeds without harming the effectiveness thereof at high speeds.

Figure 5:
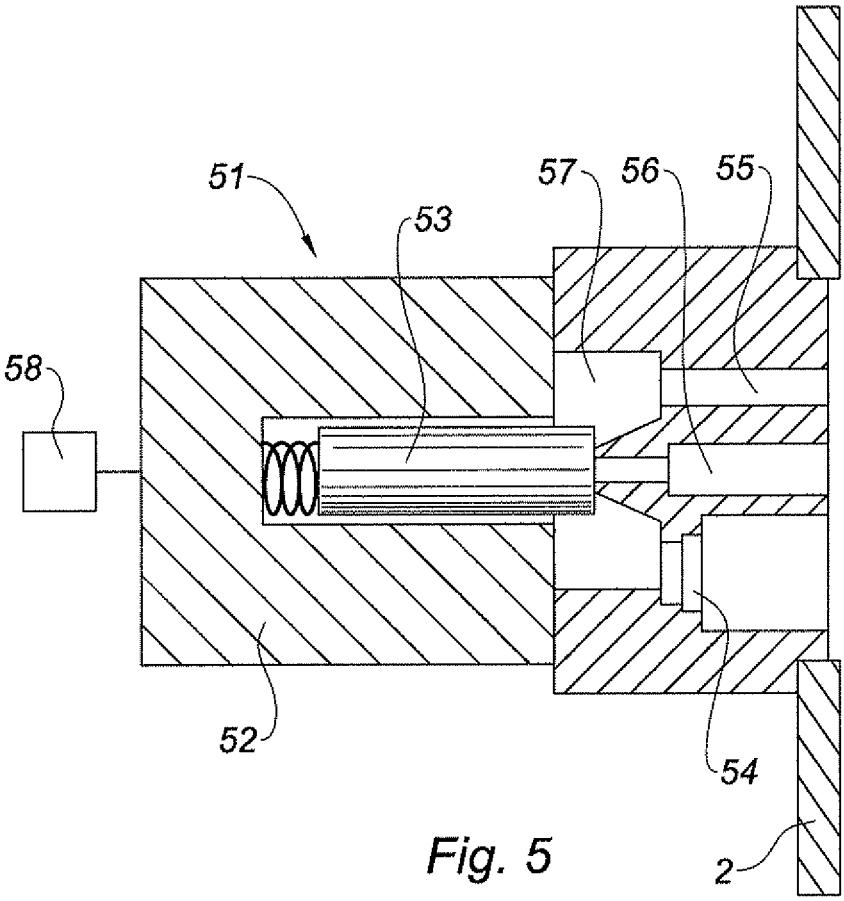
FIG. 5 is a cross-sectional view of a solenoid valve belonging to a compressor according to a second embodiment of the invention.

FIG. 5 shows a partial view of a compressor according to a second embodiment of the invention that differs from that shown in FIG. 1 essentially in that the oil injection device comprises a solenoid valve 51 in place of the connector 41.

The solenoid valve 51 includes a body 52 mounted on the sealed enclosure 2 of the compressor and a core 53 housed in the body 52. The body 52 of the solenoid valve includes an oil inlet port 54 supplied with oil by the supply duct 43 connected to the first outlet port 39 of the oil pump 36, a first oil outlet port 55 connected to the oil injection ducts 44, and a second oil outlet port 56 emerging in the sealed enclosure. The core can move, under the effect of the magnetic field, between a position closing the second oil outlet port 55, in which all of the oil entering the solenoid valve through the oil inlet port 54 is oriented toward the first oil outlet port 55, and a position opening the second oil outlet port 56, in which all or nearly all of the oil entering the solenoid valve through the oil inlet port 54 is oriented toward the second oil outlet port 56. The oil in the port 54 is connected to the oil outlet ports 55, 56 by a connecting chamber 57 formed in the body of the solenoid valve 51.

According to the second embodiment, the compressor comprises monitoring means 58 arranged to move the core 53 of the solenoid valve between its open and closed positions as a function of the speed of rotation of the rotor of the electric motor. Monitoring means 58 are preferably arranged to move the core 53 of the solenoid valve 51 into its open position when the speed of the rotor 22 is above a predetermined value belonging to the second speed range.

In this way, as long as the speed of rotation of the rotor 22 is below the predetermined value, the core 53 is kept in its closed position and all of the oil entering a solenoid valve 51 through the oil inlet port 54 is oriented toward the compression stage 7 via the first oil outlet port 55 in the injection ducts 44. When the speed of rotation of the rotor 22 exceeds the predetermined value, the monitoring means 58 move the core 53 into its second position and all or nearly all of the oil entering the solenoid valve 51 through the oil inlet port 54 is oriented toward the second oil outlet port 56, due to the fact that at high speeds, the pressure losses formed in the first oil outlet port 55 and each injection duct 44 are substantially greater than those formed in the second oil outlet port 56.

As a result, the injection device including the solenoid valve 51 ensures a supply of oil for the compression stage 7 and a return of oil toward the oil sump 38 similarly to the injection device shown in FIG. 1.

Figure 6:
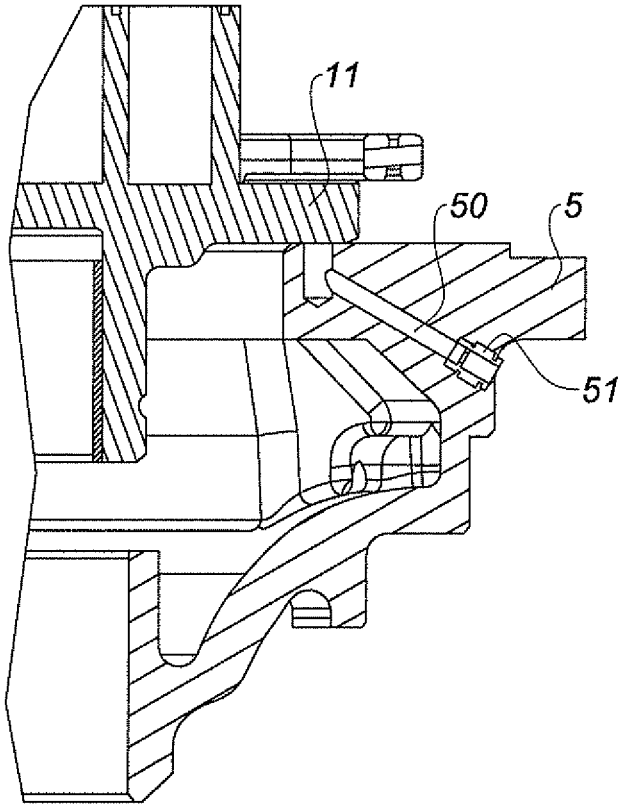
FIG. 6 is a partial cross-sectional view of a compressor according to a third embodiment of the invention.

FIG. 6 shows a partial view of a compressor according to a third embodiment of the invention that differs from that shown in FIG. 1 essentially in that the end of each through bore 50 formed the body 5 separating the compression and suction volumes is covered by the moving volume 11 during all of the orbital movement thereof. According to this embodiment, the injection nozzle 51 of each oil injection duct is situated at the end of the corresponding through bore 50 opposite the moving volute 11.

The invention is of course not limited solely to the embodiments of this compressor described above as examples, but on the contrary encompasses all alternative embodiments.

The invention claimed is:

1. A variable-speed scroll refrigeration compressor, comprising:

a sealed enclosure containing a compression stage, an oil sump housed in a lower portion of the sealed enclosure, an electric motor having a stator and a rotor, an oil pump rotationally coupled to the rotor of the electric motor, the oil pump comprising an oil inlet port connected to the oil sump of the compressor and at least one first oil output port, and control means arranged to control the operation of the electric motor according to at least one start-up mode in which the rotor of the electric motor is rotated at a first speed of rotation comprised in a first speed range, and a normal operating mode in which the rotor is rotated at a second speed of rotation comprised in a second speed range, the second speed range being higher than the first speed range, wherein the compressor comprises an oil injection device including at least one oil injection duct connected to the first oil outlet port of the oil pump and arranged to supply the compression stage of the compressor with oil, and the control means include monitoring means arranged to vary a value that is representative of an output torque of the electric motor so as to keep the first speed of rotation substantially constant during the start-up mode, the control means being arranged to control the operation of the electric motor in the start-up mode until the value representative of the output torque becomes lower than a predetermined value.

2. The compressor according to claim 1, wherein the monitoring means are arranged to vary the feed current of the electric motor so as to keep the first speed of rotation substantially constant during the start-up mode, the control means being arranged to command operation of the electric motor in the start-up mode until the value of the feed current of the electric motor becomes lower than a predetermined current value.

3. The compressor according to claim 1, which comprises a drive shaft rotationally coupled to the rotor of the electric motor and arranged to rotate the oil pump, the oil pump comprising a second oil outlet port connected to a lubrication duct formed in a central portion of the drive shaft.

4. The compressor according to claim 1, wherein the sealed enclosure has a suction volume and a compression volume respectively arranged on either side of a body contained in the sealed enclosure, the suction volume including the oil sump and the compression volume including the compression stage, an end of each oil injection duct opposite the oil pump emerging in the compression volume.

5. The compressor according to claim 4, wherein the end portion of each oil injection duct opposite the oil pump is inserted into a through bore formed in the body separating the compression and suction volumes.

6. The compressor according to claim 1, wherein each oil injection duct comprises a choke member mounted at the end of the oil injection duct opposite the oil pump.

7. The compressor according to claim 1, wherein the oil injection device also comprises an oil return duct connected to the first oil output port of the oil pump and designed to return the oil into the oil sump of the compressor, and wherein each oil injection duct and the oil return duct are configured such that the pressure losses in each oil injection duct are primarily singular pressure losses proportional to the square of the oil flow rate passing through said oil injection duct, and the pressure losses in the oil return duct are primarily pressure losses due to friction proportional to the oil flow rate passing through the oil return duct.

8. The compressor according to claim 7, wherein the oil injection device comprises a connector including at least one oil inlet port supplied with oil by a supply duct connected to the first output port of the oil pump, a first oil outlet port connected to the at least one oil injection duct, and a second oil outlet port connected to the oil return duct.

9. The compressor according to claim 1, wherein the oil injection device comprises a solenoid valve having a body mounted on the sealed enclosure and a core housed in the body of the solenoid valve, the body of the solenoid valve having at least one oil inlet port supplied with oil by a supply duct connected to the first outlet port of the oil pump, a first oil outlet port connected to the at least one oil injection duct emerging in the compression stage, and a second oil outlet port emerging in the sealed enclosure, the core being able to move, under the effect of a magnetic field, between the closing position of the second oil outlet port, in which all of the oil entering the solenoid valve through the oil inlet port is oriented toward the first oil outlet port, and an open position of the second oil outlet port, in which all or nearly all of the oil entering the solenoid valve through the oil inlet port is oriented toward the second oil outlet port.

* * * * *